US007575008B1

(12) United States Patent
Casey

(10) Patent No.: US 7,575,008 B1
(45) Date of Patent: Aug. 18, 2009

(54) HEATED UMBRELLA AND ASSOCIATED METHOD

(76) Inventor: Kathleen P Casey, P.O. Box 3872, Palos Verdes Peninsula, CA (US) 90274

( * ) Notice: Subject to any disclaimer, the term of this patent is extended or adjusted under 35 U.S.C. 154(b) by 0 days.

(21) Appl. No.: 11/903,052

(22) Filed: Sep. 21, 2007

Related U.S. Application Data

(60) Provisional application No. 60/859,865, filed on Nov. 20, 2006.

(51) Int. Cl.
*A45B 3/00* (2006.01)

(52) U.S. Cl. ..... 135/16

(58) Field of Classification Search ..... 135/16, 135/92, 91, 25.4
See application file for complete search history.

(56) References Cited

U.S. PATENT DOCUMENTS 3,739,792 A * 6/1973 Holland ..... 135/16
5,207,238 A * 5/1993 Rivera et al. ..... 135/16
5,273,062 A 12/1993 Mozdzanowski
5,349,975 A * 9/1994 Valdner ..... 135/16
5,964,233 A 10/1999 Clark
6,039,062 A * 3/2000 Karakaedos ..... 135/16
6,209,556 B1 * 4/2001 Yu ..... 135/15.1
6,298,866 B1 10/2001 Molnar
6,336,450 B1 * 1/2002 Collet ..... 126/92 B
7,003,217 B2 * 2/2006 Bachinski et al. ..... 392/411

* cited by examiner

*Primary Examiner*—Peter R Brown
*Assistant Examiner*—Patrick Lynch

(57) ABSTRACT

A heated umbrella includes a concave canopy. Such a canopy is adapted between folded and unfolded positions respectively, and is formed from waterproof material. The canopy includes a circular and flexible covering and a plurality of linear spokes integrally attached to a lower surface of the covering along respective longitudinal lengths of the spokes. The device further includes a shaft directly connected to a center region of the canopy and a handle integrally attached to the shaft. The device further includes a mechanism for heating ambient air and a mechanism for directing the heated air through the shaft and the canopy respectively.

4 Claims, 6 Drawing Sheets

HEATED UMBRELLA AND ASSOCIATED METHOD

CROSS REFERENCE TO RELATED APPLICATIONS

This application claims the benefit of U.S. Provisional Application No. 60/859,865, filed Nov. 20, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to umbrellas and, more particularly, to a heated umbrella for assisting a user to stay warm while employing the heated umbrella during inclement weather conditions.

2. Prior Art

Umbrellas are well known in the prior art. These apparatuses come in many shapes and forms ranging from large patio and beach umbrellas to more compact, and usually collapsible, personal umbrellas. In general, the purpose of the smaller personal umbrella is to provide a user with protection from inclement weather conditions like rain, snow or hail. Although the umbrella is sufficient in design to accomplish this task, it neglects one very important consideration. Typically, during inclement weather, a person needs not only protection from rain and the like, but also the cold temperatures associated with such weather conditions. Unfortunately, only some larger umbrellas, like the patio types mentioned before, have a means for generating heat in the immediate area therebeneath.

U.S. Pat. No. 5,273,062 to Mozdzanowski discloses a beach umbrella with a shaft, ribs, gores, stretchers, and a runner to open and close the umbrella. A container is attached to the runner, and the container includes a radio and a locked storage compartment. A fan assembly is also attached to the runner to force air downward onto a person under the umbrella. The umbrella also has a base with threads on the lower end of the base, so the umbrella can be threaded into the ground. A platform on the base provides a stable foundation, and handles on the platform facilitate the threading of the umbrella into the ground. Unfortunately, this prior art example does not provide a means for keeping a user warm during inclement weather.

U.S. Pat. No. 5,964,233 to Clark discloses a patio umbrella that includes a dining table and a fuel-burning radiant heater that avoids overheating of the upper canopy by mounting the support on which the upper canopy rests in the shadow cast by a reflector that converges upwardly to a chimney portion. The reflector is affixed to the housing of the combustion chamber. In addition to reflecting radiant heat downwardly onto the table and the diners, the reflector shields the upper canopy support from radiant heat and provides a duct for venting the products of combustion. As the latter pass up through the chimney portion, cooler air is drawn up through the space between the reflector and the upper canopy support thereby preventing hot air from stagnating there. The upper canopy support is mounted to the reflector and spaced above it by a number of insulative ceramic spacers. Brackets affixed to the reflector extend outwardly of the pivotal attachment of the ribs of the umbrella, thereby permitting the ribs to clear the combustion chamber and at the same time shortening the ribs so that when the umbrella is closed the lower ends of the ribs are well above the table top so as not to intrude into the space used for serving food. A safety switch, mounted within the column that supports the heater, extinguishes the heater as the umbrella is closed. Unfortunately, this prior art example is not designed for portable and personal use.

U.S. Pat. No. 6,298,866 to Molnar discloses a table umbrella apparatus with a base, an umbrella with an inner surface extending therealong, a tubular support affixed to and extending from the base and supporting the umbrella a desired distance above the base, and a fan connected to the tubular support. The fan has a fan blade mounted so as to rotate about a vertical axis. The fan directs air flow at least upwardly toward the umbrella. A motor is connected to the fan so as to rotate the fan blade in a desired direction. A baffle is affixed to umbrella so as to direct air from the fan along the inner surface of the umbrella. The umbrella has at least one adjustable slat extending outwardly from the inner surface so as to direct air flow from the fan to a desired location below the umbrella. A table is positioned around the tubular support and over the base. Unfortunately, this prior art example is not designed for portable and personal use.

Accordingly, the present invention is disclosed in order to overcome the above noted shortcomings. The present invention satisfies such a need by providing a device that is convenient and easy to use, lightweight yet durable in design, and designed for assisting a user to stay warm while employing the heated umbrella during inclement weather conditions. The heated umbrella provides a user a simple mechanism of staying warm and comfortable when spending time outdoors during inclement weather. The heated umbrella advantageously includes an integrated heated element and system of air vents that blow warm air about the interior of the umbrella canopy. The present invention is simple to use, inexpensive, and designed for many years of repeated use.

BRIEF SUMMARY OF THE INVENTION

In view of the foregoing background, it is therefore an object of the present invention to provide a mechanism for assisting a user to stay warm while employing the heated umbrella during inclement weather conditions. These and other objects, features, and advantages of the invention are provided by a heated umbrella.

A heated umbrella includes a concave canopy. Such a canopy is effectively adapted between folded and unfolded positions respectively, and is formed from waterproof material. The canopy includes a circular and flexible covering and a plurality of linear spokes integrally attached to a lower surface of the covering along respective longitudinal lengths of the spokes. Each of such spokes has a proximal end attached to a center region of the covering and further has a distal end extending radially away from the center region of the covering. Each of such distal ends of the spokes conveniently terminates at an outer edge of the covering and is equidistantly spaced along the outer edge of the covering. Each of the spokes has a hollow channel formed therein and extends along the longitudinal length thereof.

The canopy further includes a plurality of holes formed in an outer surface of each of the spokes. Such holes are in fluid communication with associated ones of the channels of the spokes and are equidistantly spaced along the respective longitudinal lengths of each of the spokes. The holes advantageously face toward an interior portion of the canopy and the user positioned therein respectively when the canopy is adapted to the unfolded position.

The device further includes a shaft directly connected to a center region of the canopy. Such a shaft effectively includes an upper section with a top end directly connected to the center region of the covering and the proximal ends of the spokes respectively. Such an upper section has a bottom end extending downwardly and away from the top end of the upper section. The shaft further includes a lower section with a longitudinal length equal to a longitudinal length of the upper section. Such a lower section conveniently has a diameter that is greater than a diameter of the upper section such that the upper section is telescopically interfitted within the lower section and adjusted along the longitudinal length of the lower section. Each of the upper and lower sections has a hollow passageway formed therein. Each of such passageways is in fluid communication with each other and with the hollow channels of the spokes respectively.

The device further includes a handle integrally attached to the shaft. Such a handle is directly attached to a bottom end of the lower shaft and has a hollow cavity formed therein. Such a cavity is advantageously in fluid communication with the passageway of the lower section of the shaft. The device further includes a mechanism for heating ambient air. Such a heating mechanism is housed within the handle and includes a user interface formed in an exterior surface of the handle and a first switch directly connected to such a user interface and disposed exterior thereof.

The heating mechanism further includes a power supply source electrically coupled to the user interface. Such a power supply source is effectively housed within the cavity of the handle. The heating mechanism further includes a heating element electrically coupled to the first switch and the power supply source respectively. Such a heating element is housed within the cavity of the handle. The heating mechanism further includes a fan electrically coupled to the user interface and the power supply source respectively and directly connected to the heating element. Such a fan is housed within the handle and located upstream of the heating element and is in fluid communication with the heating element.

The device further includes a mechanism for directing the heated air through the shaft and the canopy respectively. Such an air directing mechanism is in fluid communication with the heating mechanism and includes a double-throw double-pole switch disposed exterior of the user interface and located adjacent to the first switch. Such a double-pole double-throw switch conveniently has a first plurality of conductive nodes and a second plurality of conductive nodes respectively. The double-throw double-pole switch is electrically coupled to the power supply source.

The air directing mechanism further includes a distribution valve housing electrically coupled to the double-throw double-pole switch and the power supply source respectively. Such a valve housing is directly attached to the top end of the upper section of the shaft and the proximal ends of the spokes respectively. The air directing mechanism further includes a plurality of valves housed within the valve housing and electrically coupled thereto. Each of such valves is in fluid communication with the passageway of the upper section of the shaft and an associated one of the proximal ends of the spokes respectively. The valve housing and the valves respectively cooperating to allow heated air from the shaft to pass therethrough and into selected ones of the spokes and outwardly through the associated ones of the holes respectively based upon a position of the double-throw double-pole switch.

The double-throw double-pole switch advantageously allows heated air from the shaft to pass through the plurality of valves and into the plurality of the spokes and outwardly through the plurality of the holes respectively when the double-throw double-pole switch is in a first position. The first position of the double-throw double-pole switch corresponds to a position whereby the double-throw double-pole switch simultaneously contacts a selected one of the first plurality of conductive nodes and a selected one of the second plurality of conductive nodes respectively.

The double-throw double-pole switch effectively allows heated air from the shaft to pass through a selected plurality of the valves and into an associated plurality of the spokes and outwardly through associated ones of the holes of the selected plurality of spokes respectively when the double-throw double-pole switch is in a second position. The double-throw double-pole switch simultaneously conveniently prohibits heated air from the shaft from passing through another plurality of the valves and into another associated plurality of the spokes and outwardly through another associated ones of the holes of the another plurality of spokes respectively when the double-throw double-pole switch is in the second position.

The second position of the double-throw double-pole switch corresponds to a position whereby the double-throw double-pole switch contacts the first plurality of conductive nodes simultaneously. The double-throw double-pole switch allows heated air from the shaft to advantageously pass through another plurality of the valves and into the another associated plurality of the spokes and outwardly through the another associated ones of the holes of the another plurality of spokes respectively when the double-throw double-pole switch is in a third position. The double-throw double-pole switch simultaneously prohibits heated air from the shaft from passing through the selected plurality of the valves and into the associated plurality of the spokes and outwardly through the associated ones of the holes of the selected plurality of spokes respectively when the double-throw double-pole switch is in the third position.

The third position of the double-throw double-pole switch effectively corresponds to a position whereby the double-throw double-pole switch contacts the second plurality of conductive nodes simultaneously. The double-throw double-pole switch contacts the second plurality of conductive nodes independently of the first plurality of the conductive nodes.

A method for assisting a user to stay warm while employing a heated umbrella during inclement weather conditions includes the steps of providing a concave canopy and adapting the canopy between folded and unfolded positions respectively. Such a canopy is formed from waterproof material. The steps further include: providing a shaft directly connected to a center region of the canopy; providing a handle integrally attached to the shaft; heating ambient air, the heating mechanism housed within the handle; and directing the heated air through the shaft and the canopy respectively, the air directing mechanism in fluid communication with the heating mechanism.

The method of further includes the steps of directing heated air from the shaft through the plurality of valves and into the plurality of the spokes and outwardly through the plurality of the holes respectively when the double-throw double-pole switch is in a first position. The first position of the double-throw double-pole switch corresponds to a position whereby the double-throw double-pole switch simultaneously contacts a selected one of the first plurality of conductive nodes and a selected one of the second plurality of conductive nodes respectively.

The steps further include directing heated air from the shaft through a selected plurality of the valves and into an associated plurality of the spokes and outwardly through associated ones of the holes of the selected plurality of spokes respectively when the double-throw double-pole switch is in a second position. The double-throw double-pole switch simultaneously prohibits heated air from the shaft from passing through another plurality of the valves and into another associated plurality of the spokes and outwardly through another associated ones of the holes of the another plurality of spokes respectively when the double-throw double-pole switch is in the second position. The second position of the double-throw double-pole switch corresponds to a position whereby the double-throw double-pole switch contacts the first plurality of conductive nodes simultaneously.

The steps further include directing heated air from the shaft through another plurality of the valves and into another associated plurality of the spokes and outwardly through another associated ones of the holes of the another plurality of spokes respectively when the double-throw double-pole switch is in the third position. The double-throw double-pole switch simultaneously prohibits heated air from the shaft from passing through the selected plurality of the valves and into the associated plurality of the spokes and outwardly through the associated ones of the holes of the selected plurality of spokes respectively when the double-throw double-pole switch is in the third position.

The third position of the double-throw double-pole switch corresponds to a position whereby the double-throw double-pole switch contacts the second plurality of conductive nodes simultaneously. The double-throw double-pole switch contacts the second plurality of conductive nodes independently of the first plurality of the conductive nodes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
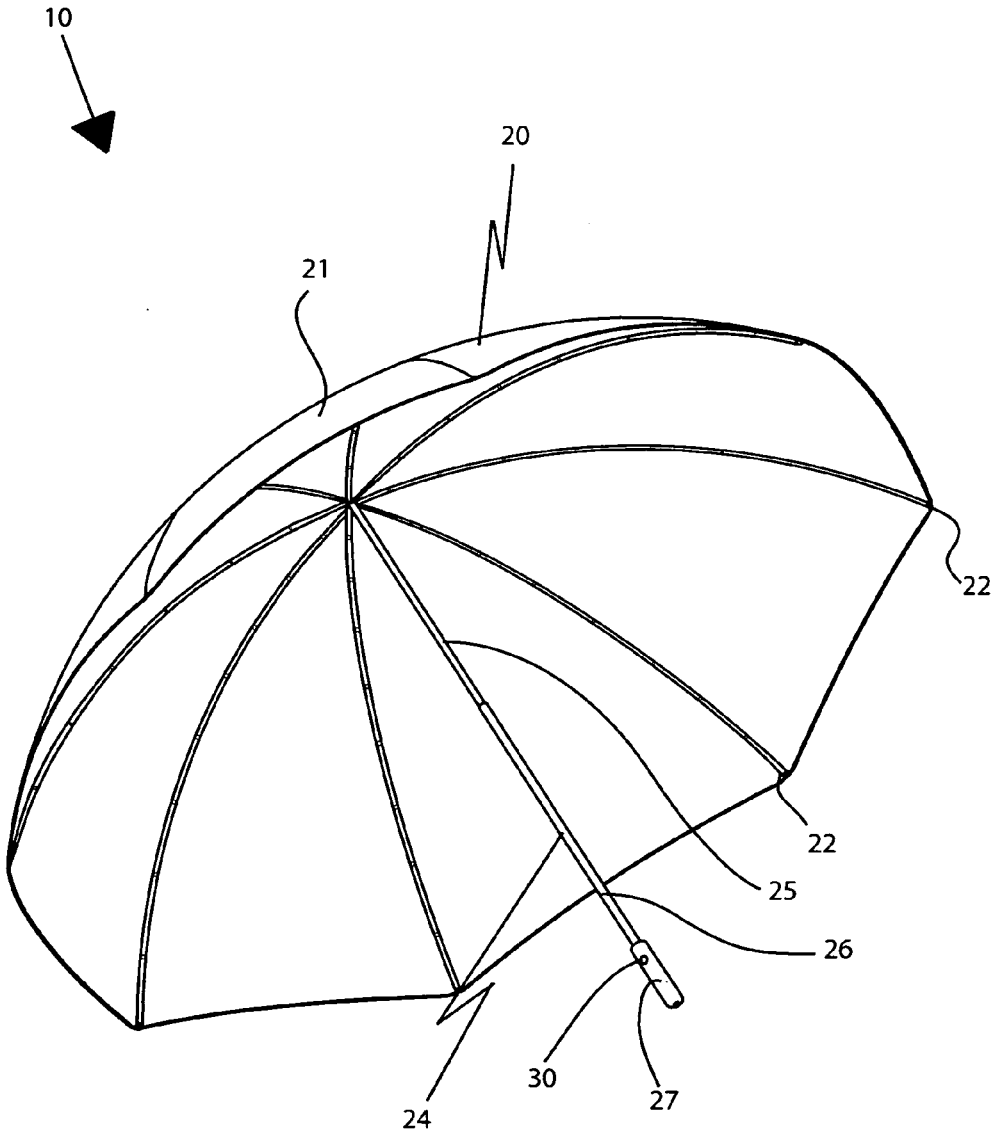
FIG. 1 is a perspective view of a heated umbrella, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-7 by the reference numeral 10 and is intended to provide a mechanism for assisting a user to stay warm while employing the heated umbrella during inclement weather conditions. It should be understood that the device 10 may be used to heat many different types of umbrellas and should not be limited in heating only those types of umbrellas mentioned herein.

Referring initially to FIGS. 1, 2, 3 and 4, a heated umbrella includes a concave canopy 20. Such a canopy 20 is adapted between folded and unfolded positions respectively, and is formed from waterproof material. The canopy 20 includes a circular and flexible covering 21 and a plurality of linear spokes 22 integrally attached to a lower surface of the covering 21 along respective longitudinal lengths of the spokes 22. Each of such spokes 22 has a proximal end attached to a center region of the covering 21 and further has a distal end extending radially away from the center region of the covering 21. Each of such distal ends of the spokes 22 terminates at an outer edge of the covering 21 and is equidistantly spaced along the outer edge of the covering 21. Each of the spokes 22 has a hollow channel formed therein and extends along the longitudinal length thereof. The canopy provides a mechanism for advantageously shielding a user against rain, snow, and other precipitation.

The canopy further includes a plurality of holes 23 formed in an outer surface of each of the spokes 22. Such holes 23 are in fluid communication with associated ones of the channels of the spokes 22 and are equidistantly spaced along the respective longitudinal lengths of each of the spokes 22. The holes 23 face toward an interior portion of the canopy 20 and the user positioned therein respectively when the canopy 20 is adapted to the unfolded position. The holes 23 provide a mechanism for allowing warm air to blow down onto a user from the canopy section of the umbrella.

Figure 2:
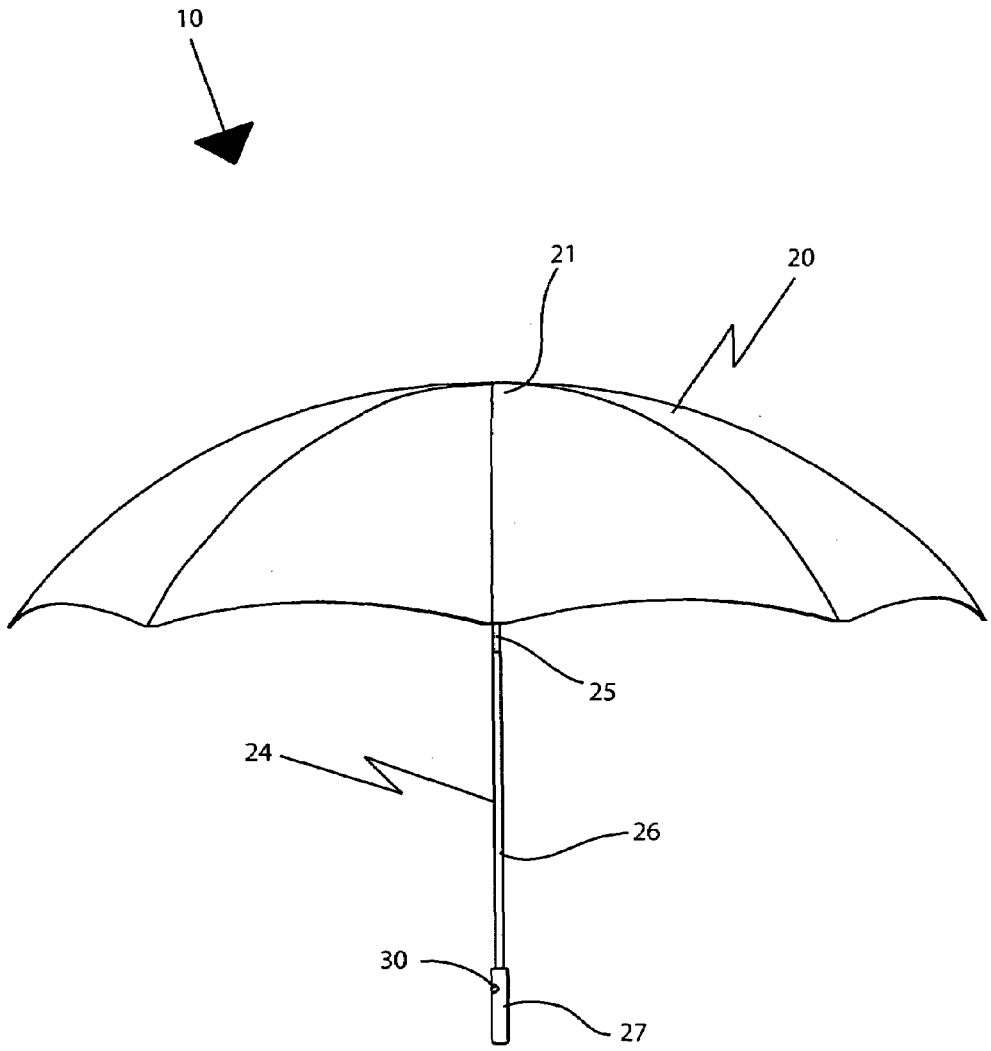
FIG. 2 is a front elevational view of a heated umbrella as shown in FIG. 1.
Figure 3:
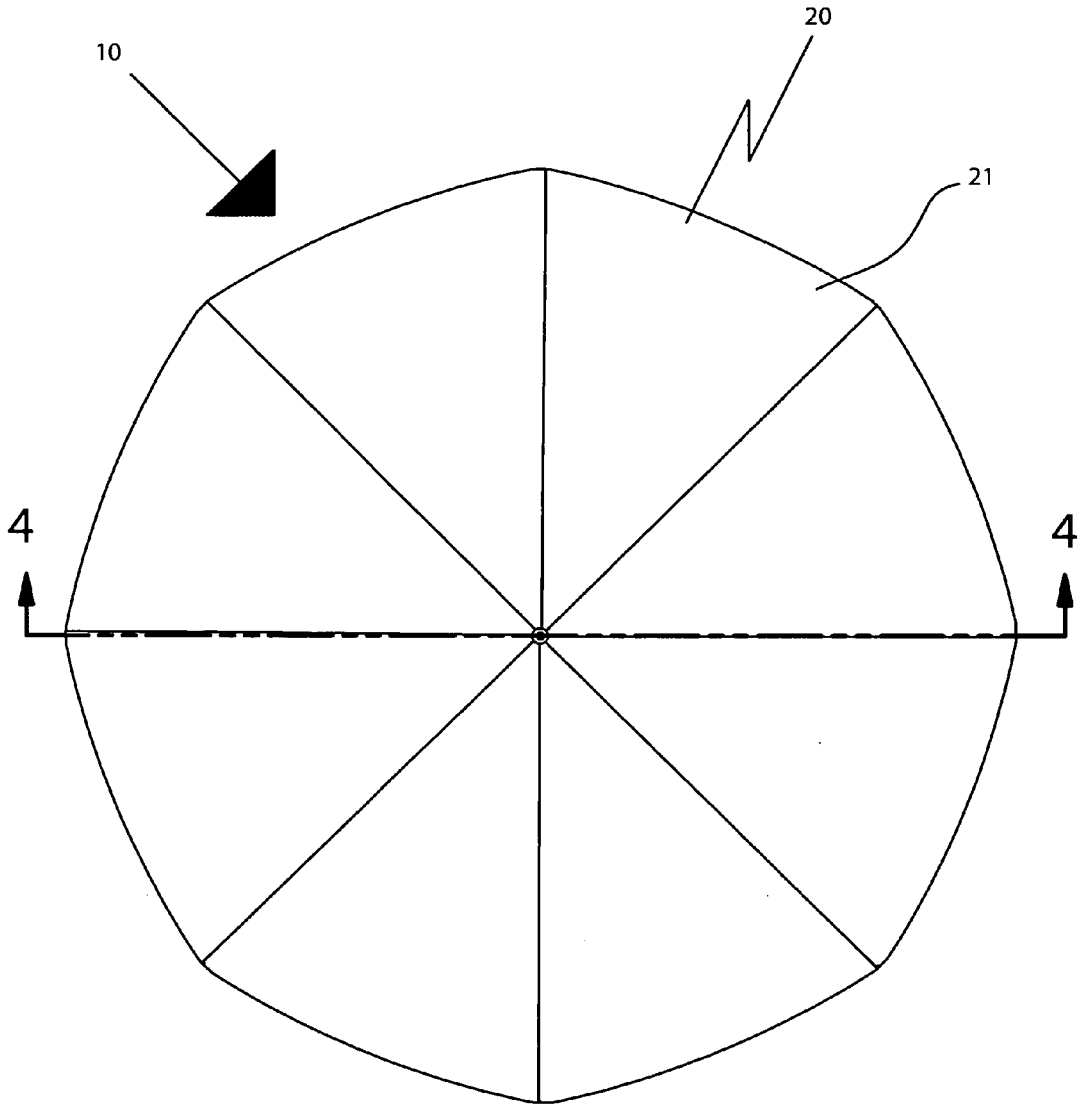
FIG. 3 is a top planar view of a heated umbrella, in accordance with the present invention.
Figure 4:
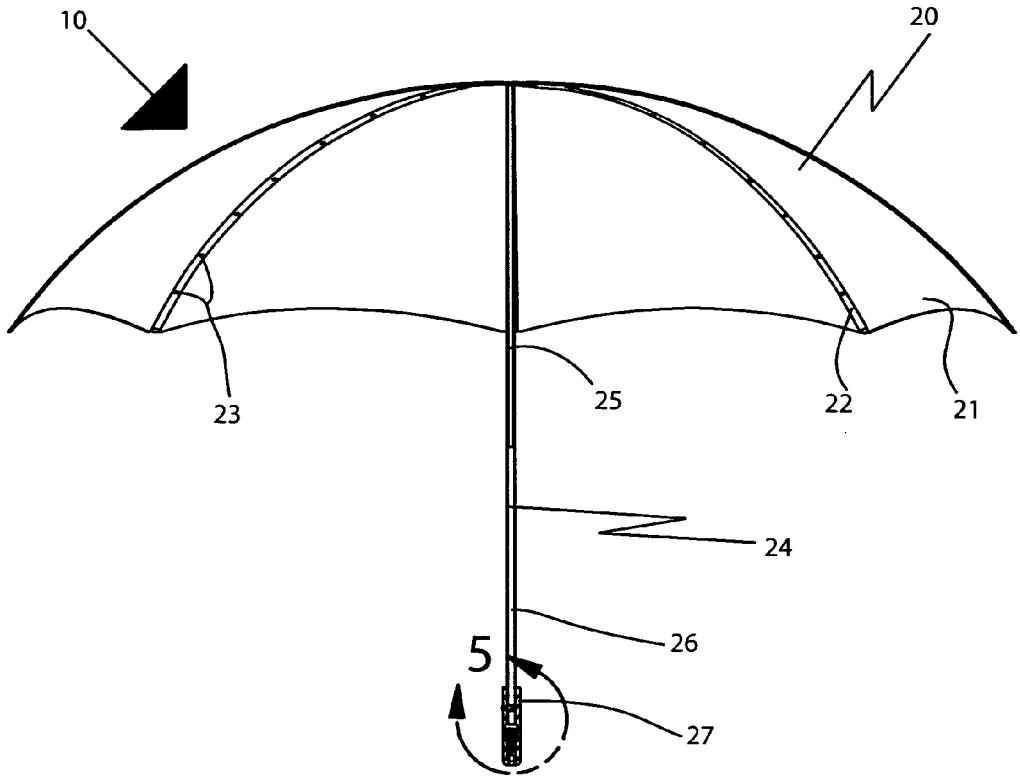
FIG. 4 is a cross sectional view of a heated umbrella, taken along line 4-4, as shown in FIG. 3.
Figure 5:
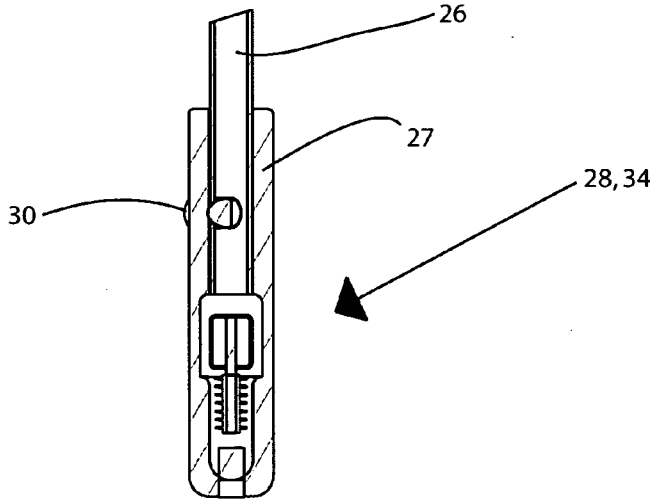
FIG. 5 is an enlarged cross sectional view of the handle of a heated umbrella, as shown in FIG. 4.

Referring to FIGS. 1, 2 and 4, the device further includes a shaft 24 directly connected to a center region of the canopy 20. Such a shaft 24 includes an upper section 25 with a top end directly connected, without the use of intervening characters, to the center region of the covering 21 and the proximal ends of the spokes 22 respectively. Such an upper section 25 has a bottom end extending downwardly and away from the top end of the upper section. The shaft further includes a lower section 26 with a longitudinal length equal to a longitudinal length of the upper section 25. Such a lower section 26 has a diameter that is greater than a diameter of the upper section 25 which is essential such that the upper section 25 is telescopically interfitted within the lower section 26 and adjusted along the longitudinal length of the lower section. Each of the upper and lower sections 25, 26 has a hollow passageway formed therein. Each of such passageways is in fluid communication with each other and with the hollow channels of the spokes respectively. The telescopic shaft provides a mechanism for extending the canopy section over a user head when necessary and condensing the shaft, when the umbrella is no longer needed, in order to make storage of the umbrella much more convenient.

Referring to FIGS. 1, 2, 4, 5 and 6, the device further includes a handle 27 integrally attached to the shaft. Such a handle 27 is directly attached, without the use of intervening characters, to a bottom end of the lower shaft 26 and has a hollow cavity formed therein. Such a cavity is in fluid communication with the passageway of the lower section of the shaft 24. The handle provides a mechanism for comfortably maintaining a secure grip of the shaft, thereby ensuring that the canopy portion of the umbrella remains properly positioned over the user head to maintain adequate protection from any inclement weather. The device further includes a mechanism for heating ambient air 28. Such a heating mechanism 28 is housed within the handle 27 and includes a user interface 29 formed in an exterior surface of the handle 27 and a first switch 30 directly connected to such a user interface 29 and disposed exterior thereof. The heating mechanism allows a user to remain toasty warm even in the chilliest of temperatures.

Figure 6:
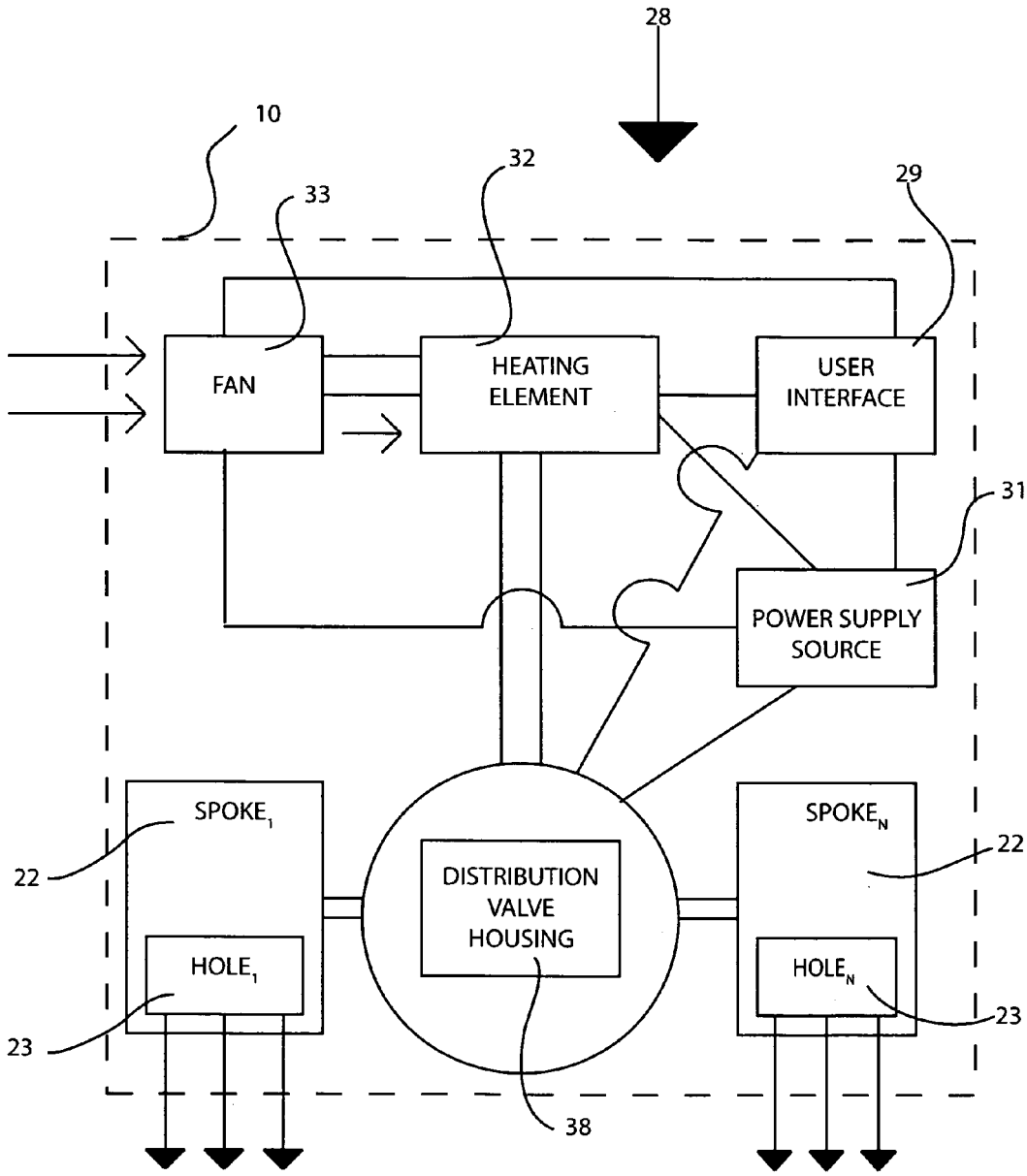
FIG. 6 is a schematic block diagram showing the heating mechanism, in accordance with the present invention.

Referring to FIG. 6, the heating mechanism further includes a power supply source 31 electrically coupled to the user interface 29. Such a power supply source 31 is housed within the cavity of the handle 27. The heating mechanism 28 further includes a heating element 32 electrically coupled to the first switch 30 and the power supply source 31 respectively. Such a heating element 32 is housed within the cavity of the handle 27. The heating mechanism further includes a fan 33 electrically coupled to the user interface 29 and the power supply source 31 respectively and directly connected, without the use of intervening characters, to the heating element 32. Such a fan 33 is housed within the handle 27 and located upstream of the heating element 32 and is in fluid communication with the heating element 32. The handle conveniently provides a mechanism for housing and protecting the heating mechanism and its components, respectively.

Figure 7:
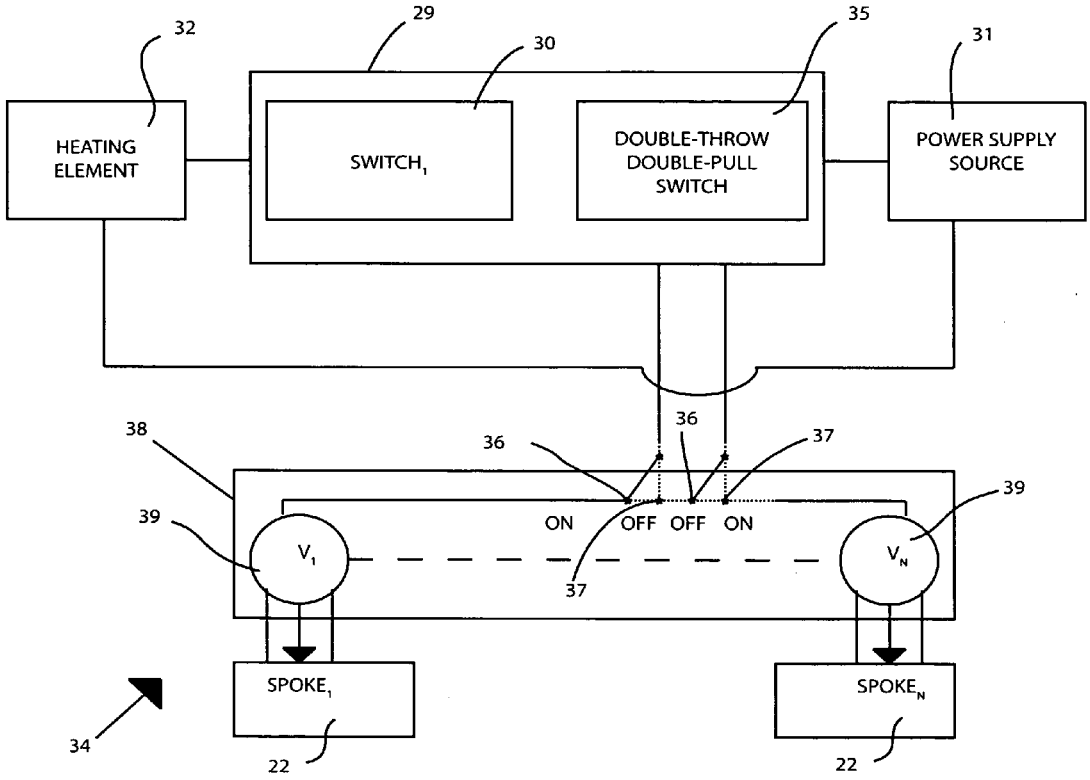
FIG. 7 is a schematic block diagram showing the air distributing mechanism, in accordance with the present invention.

Referring to FIG. 7, the device further includes a mechanism for directing the heated air through the shaft and the canopy respectively. Such an air directing mechanism 34 is in fluid communication with the heating mechanism 28 and includes a double-throw double-pole switch 35 disposed exterior of the user interface 29 and located adjacent to the first switch. Such a double-pole double-throw switch 35 has a first plurality of conductive nodes 36 and a second plurality of conductive nodes 37 respectively. The double-throw double-pole switch 35 is electrically coupled to the power supply source 31. The air directing mechanism allows the heated air to reach all of the holes throughout the heated umbrella in order to surround a user with soothing heat.

The air directing mechanism further includes a distribution valve housing 38 electrically coupled to the double-throw double-pole switch 35 and the power supply source 31 respectively. Such a valve housing 38 is directly attached, without the use of intervening characters, to the top end of the upper section 25 of the shaft and the proximal ends of the spokes 22 respectively. The air directing mechanism further includes a plurality of valves 39 housed within the valve housing 38 and electrically coupled thereto. Each of such valves 39 is in fluid communication with the passageway of the upper section of the shaft and an associated one of the proximal ends of the spokes 22 respectively. The valve housing 38 and the valves 39 respectively cooperating to allow heated air from the shaft 26 to pass therethrough and into selected ones of the spokes 22 and outwardly through the associated ones of the holes 23 respectively based upon a position of the double-throw double-pole switch 35.

The double-throw double-pole switch 35 allows heated air from the shaft 26 to pass through the plurality of valves 39 and into the plurality of the spokes 22 and outwardly through the plurality of the holes 23 respectively when the double-throw double-pole switch 35 is in a first position. The first position of the double-throw double-pole switch 35 corresponds to a position whereby the double-throw double-pole switch 35 simultaneously contacts a selected one of the first plurality of conductive nodes 36 and a selected one of the second plurality of conductive nodes 37 respectively.

The double-throw double-pole switch 35 allows heated air from the shaft 26 to pass through a selected plurality of the valves 39 and into an associated plurality of the spokes 22 and outwardly through associated ones of the holes 23 of the selected plurality of spokes 22 respectively when the double-throw double-pole switch 35 is in a second position. The double-throw double-pole switch 35 simultaneously prohibits heated air from the shaft 26 from passing through another plurality of the valves 39 and into another associated plurality of the spokes 22 and outwardly through another associated ones of the holes 23 of the another plurality of spokes 22 respectively when the double-throw double-pole switch 35 is in the second position.

The second position of the double-throw double-pole switch 35 corresponds to a position whereby the double-throw double-pole switch 35 contacts the first plurality of conductive nodes 36 simultaneously. The double-throw double-pole switch 35 allows heated air from the shaft 26 to pass through another plurality of the valves 39 and into the another associated plurality of the spokes 22 and outwardly through the another associated ones of the holes 23 of the another plurality of spokes 22 respectively when the double-throw double-pole switch 35 is in a third position. The double-throw double-pole switch 35 simultaneously prohibits heated air from the shaft 26 from passing through the selected plurality of the valves 39 and into the associated plurality of the spokes 22 and outwardly through the associated ones of the holes 23 of the selected plurality of spokes 22 respectively when the double-throw double-pole switch 35 is in the third position.

The third position of the double-throw double-pole switch 35 corresponds to a position whereby the double-throw double-pole switch 35 contacts the second plurality of conductive nodes 37 simultaneously. The double-throw double-pole switch 35 contacts the second plurality of conductive nodes 37 independently of the first plurality of the conductive nodes 36.

The heating mechanism provides the unexpected benefit of allowing a user to remain warm even in frigid temperatures, while also remaining dry through the protection of the canopy. In addition, the air distributing mechanism provides a mechanism for blowing heat throughout the entire umbrella, thereby ensuring that a user is surrounded by rather than receiving heat in one steady stream. Such benefits overcome the prior art shortcomings.

In use, a method for assisting a user to stay warm while employing a heated umbrella during inclement weather conditions includes the steps of providing a concave canopy 20 and adapting the canopy between folded and unfolded positions respectively. Such a canopy 20 is formed from waterproof material. The steps further include: providing a shaft 24 directly connected to a center region of the canopy 20; providing a handle 27 integrally attached to the shaft 24; heating ambient air entering upwardly through the handle 27; and directing the heated air through the shaft 24 and the canopy 20 respectively.

In use, the method of further includes the steps of directing heated air from the shaft 24 through the plurality of valves 39 and into the plurality of the spokes 22 and outwardly through the plurality of the holes 23 respectively when the double-throw double-pole switch 35 is in a first position. The first position of the double-throw double-pole switch 35 corresponds to a position whereby the double-throw double-pole switch 35 simultaneously contacts a selected one of the first plurality of conductive nodes 36 and a selected one of the second plurality of conductive nodes 37 respectively.

In use, the steps further include directing heated air from the shaft 24 through a selected plurality of the valves 39 and into an associated plurality of the spokes 22 and outwardly through associated ones of the holes 23 of the selected plurality of spokes 22 respectively when the double-throw double-pole switch 35 is in a second position. The double-throw double-pole switch 35 simultaneously prohibits heated air from the shaft 24 from passing through another plurality of the valves 39 and into another associated plurality of the spokes 22 and outwardly through another associated ones of the holes 23 of the another plurality of spokes 22 respectively when the double-throw double-pole switch 35 is in the second position. The second position of the double-throw double-pole switch 35 corresponds to a position whereby the double-throw double-pole switch 35 contacts the first plurality of conductive nodes 36 simultaneously.

In use, the steps further include directing heated air from the shaft through another plurality of the valves 39 and into another associated plurality of the spokes 22 and outwardly through another associated ones of the holes 23 of the another plurality of spokes 22 respectively when the double-throw double-pole switch 35 is in the third position. The double-throw double-pole switch 35 simultaneously prohibits heated air from the shaft from passing through the selected plurality of the valves 39 and into the associated plurality of the spokes 22 and outwardly through the associated ones of the holes 23 of the selected plurality of spokes 22 respectively when the double-throw double-pole switch 35 is in the third position.

The third position of the double-throw double-pole switch 35 corresponds to a position whereby the double-throw double-pole switch 35 contacts the second plurality of conductive nodes 37 simultaneously. The double-throw double-pole switch 35 contacts the second plurality of conductive nodes 37 independently of the first plurality of the conductive nodes 36.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A heated umbrella for assisting a user to stay warm during inclement weather conditions, said heated umbrella comprising:

a concave canopy, said canopy being adapted between folded and unfolded positions respectively;

a shaft directly connected to a center region of said canopy;

a handle integrally attached to said shaft;

means for heating ambient air, said heating means being housed within said handle; and means for directing said heated air through said shaft and said canopy respectively, said air directing means being in fluid communication with said heating means;

wherein said canopy comprises:

a circular and flexible covering;

a plurality of linear spokes integrally attached to a lower surface of said covering along respective longitudinal lengths of said spokes, each of said spokes having a proximal end attached to a center region of said covering and further having a distal end extending radially away from said center region of said covering, each of said distal ends of said spokes terminating at an outer edge of said covering, each of said distal ends of said spokes being equidistantly spaced along said outer edge of said covering, each of said spokes having a hollow channel formed therein and extending along said longitudinal length thereof; and a plurality of holes formed in an outer surface of each of said spokes, said holes being in fluid communication with associated ones of said channels of said spokes, said holes being equidistantly spaced along said respective longitudinal lengths of each of said spokes, said holes facing toward an interior portion of said canopy when said canopy is adapted to the unfolded position;

wherein said shaft comprises:

an upper section having a top end directly connected to said center region of said covering and said proximal ends of said spokes respectively, said upper section having a bottom end extending downwardly and away from said top end of said upper section; and a lower section having a longitudinal length equal to a longitudinal length of said upper section, said lower section having a diameter that is greater than a diameter of said upper section such that said upper section is telescopically interfitted within said lower section and adjusted along said longitudinal length of said lower section;

wherein each of said upper and lower sections has a hollow passageway formed therein, each of said passageways being in fluid communication with each other and with said hollow channels of said spokes respectively;

wherein said handle is directly attached to a bottom end of said lower shaft, said handle having a hollow cavity formed therein, said cavity being in fluid communication with said passageway of said lower section of said shaft;

wherein said heating means comprises;

a user interface formed in an exterior surface of said handle;

a first switch directly connected to said user interface and disposed exterior thereof;

a power supply source electrically coupled to said user interface, said power supply source being housed within said cavity of said handle;

a heating element electrically coupled to said first switch and said power supply source respectively, said heating element being housed within said cavity of said handle; and a fan electrically coupled to said user interface and said power supply source respectively and directly connected to said heating element, said fan being housed within said handle and located upstream of said heating element, said fan being in fluid communication with said heating element;

wherein said air directing means comprises:

a double-throw double-pole switch disposed exterior of said user interface and located adjacent to said first switch, said double-pole double-throw switch having a first plurality of conductive nodes and a second plurality of conductive nodes respectively, said double-throw double-pole switch being electrically coupled to said power supply source;

a distribution valve housing electrically coupled to said double-throw double-pole switch and said power supply source respectively, said valve housing being directly attached to said top end of said upper section of said shaft and said proximal ends of said spokes respectively; and a plurality of valves housed within said valve housing and electrically coupled thereto, each of said valves being in fluid communication with said passageway of said upper section of said shaft and an associated one of said proximal ends of said spokes respectively, said valve housing and said valves respectively cooperating to allow heated air from said shaft to pass therethrough and into selected ones of said spokes and outwardly through said associated ones of said holes respectively based upon a position of said double-throw double-pole switch;

wherein said double-throw double-pole switch allows heated air from said shaft to pass through said plurality of valves and into said plurality of said spokes and outwardly through said plurality of said holes respectively when said double-throw double-pole switch is in a first position;

wherein said first position of said double-throw double-pole switch corresponds to a position whereby said double-throw double-pole switch simultaneously contacts a selected one of said first plurality of conductive nodes and a selected one of said second plurality of conductive nodes respectively;

wherein said double-throw double-pole switch allows heated air from said shaft to pass through a selected plurality of said valves and into an associated plurality of said spokes and outwardly through associated ones of said holes of said selected plurality of spokes respectively when said double-throw double-pole switch is in a second position, said double-throw double-pole switch simultaneously prohibiting heated air from said shaft from passing through another plurality of said valves and into another associated plurality of said spokes and outwardly through another associated ones of said holes of said another plurality of spokes respectively when said double-throw double-pole switch is in said second position;

wherein said second position of said double-throw double-pole switch corresponds to a position whereby said double-throw double-pole switch contacts said first plurality of conductive nodes simultaneously;

wherein said double-throw double-pole switch allows heated air from said shaft to pass through said another plurality of said valves and into said another associated plurality of said spokes and outwardly through said another associated ones of said holes of said another plurality of spokes respectively when said double-throw double-pole switch is in a third position, said double-throw double-pole switch simultaneously prohibiting heated air from said shaft from passing through said selected plurality of said valves and into said associated plurality of said spokes and outwardly through said associated ones of said holes of said selected plurality of spokes respectively when said double-throw double-pole switch is in said third position;

wherein said third position of said double-throw double-pole switch corresponds to a position whereby said double-throw double-pole switch contacts said second plurality of conductive nodes simultaneously, said double-throw double-pole switch contacting said second plurality of conductive nodes independently of said first plurality of said conductive nodes.

2. A heated umbrella for assisting a user to stay warm during inclement weather conditions, said heated umbrella comprising:

a concave canopy, said canopy being adapted between folded and unfolded positions respectively, said canopy being formed from waterproof material;

a shaft directly connected to a center region of said canopy;

a handle integrally attached to said shaft;

means for heating ambient air, said heating means being housed within said handle; and means for directing said heated air through said shaft and said canopy respectively, said air directing means being in fluid communication with said heating means;

wherein said canopy comprises:

a circular and flexible covering;

a plurality of linear spokes integrally attached to a lower surface of said covering along respective longitudinal lengths of said spokes, each of said spokes having a proximal end attached to a center region of said covering and further having a distal end extending radially away from said center region of said covering, each of said distal ends of said spokes terminating at an outer edge of said covering, each of said distal ends of said spokes being equidistantly spaced along said outer edge of said covering, each of said spokes having a hollow channel formed therein and extending along said longitudinal length thereof; and a plurality of holes formed in an outer surface of each of said spokes, said holes being in fluid communication with associated ones of said channels of said spokes, said holes being equidistantly spaced along said respective longitudinal lengths of each of said spokes, said holes facing toward an interior portion of said canopy when said canopy is adapted to the unfolded position;

wherein said shaft comprises:

an upper section having a top end directly connected to said center region of said covering and said proximal ends of said spokes respectively, said upper section having a bottom end extending downwardly and away from said top end of said upper section; and a lower section having a longitudinal length equal to a longitudinal length of said upper section, said lower section having a diameter that is greater than a diameter of said upper section such that said upper section is telescopically interfitted within said lower section and adjusted along said longitudinal length of said lower section;

wherein each of said upper and lower sections has a hollow passageway formed therein, each of said passageways being in fluid communication with each other and with said hollow channels of said spokes respectively;

wherein said handle is directly attached to a bottom end of said lower shaft, said handle having a hollow cavity formed therein, said cavity being in fluid communication with said passageway of said lower section of said shaft;

wherein said heating means comprises:

a user interface formed in an exterior surface of said handle;

a first switch directly connected to said user interface and disposed exterior thereof;

a power supply source electrically coupled to said user interface, said power supply source being housed within said cavity of said handle;

a heating element electrically coupled to said first switch and said power supply source respectively, said heating element being housed within said cavity of said handle; and a fan electrically coupled to said user interface and said power supply source respectively and directly connected to said heating element, said fan being housed within said handle and located upstream of said heating element, said fan being in fluid communication with said heating element;

wherein said air directing means comprises:

a double-throw double-pole switch disposed exterior of said user interface and located adjacent to said first switch, said double-pole double-throw switch having a first plurality of conductive nodes and a second plurality of conductive nodes respectively, said double-throw double-pole switch being electrically coupled to said power supply source;

a distribution valve housing electrically coupled to said double-throw double-pole switch and said power supply source respectively, said valve housing being directly attached to said top end of said upper section of said shaft and said proximal ends of said spokes respectively; and a plurality of valves housed within said valve housing and electrically coupled thereto, each of said valves being in fluid communication with said passageway of said upper section of said shaft and an associated one of said proximal ends of said spokes respectively, said valve housing and said valves respectively cooperating to allow heated air from said shaft to pass therethrough and into selected ones of said spokes and outwardly through said associated ones of said holes respectively based upon a position of said double-throw double-pole switch;

wherein said double-throw double-pole switch allows heated air from said shaft to pass through said plurality of valves and into said plurality of said spokes and outwardly through said plurality of said holes respectively when said double-throw double-pole switch is in a first position;

wherein said first position of said double-throw double-pole switch corresponds to a position whereby said double-throw double-pole switch simultaneously contacts a selected one of said first plurality of conductive nodes and a selected one of said second plurality of conductive nodes respectively;

wherein said double-throw double-pole switch allows heated air from said shaft to pass through a selected plurality of said valves and into an associated plurality of said spokes and outwardly through associated ones of said holes of said selected plurality of spokes respectively when said double-throw double-pole switch is in a second position, said double-throw double-pole switch simultaneously prohibiting heated air from said shaft from passing through another plurality of said valves and into another associated plurality of said spokes and outwardly through another associated ones of said holes of said another plurality of spokes respectively when said double-throw double-pole switch is in said second position;

wherein said second position of said double-throw double-pole switch corresponds to a position whereby said double-throw double-pole switch contacts said first plurality of conductive nodes simultaneously;

wherein said double-throw double-pole switch allows heated air from said shaft to pass through said another plurality of said valves and into said another associated plurality of said spokes and outwardly through said another associated ones of said holes of said another plurality of spokes respectively when said double-throw double-pole switch is in a third position, said double-throw double-pole switch simultaneously prohibiting heated air from said shaft from passing through said selected plurality of said valves and into said associated plurality of said spokes and outwardly through said associated ones of said holes of said selected plurality of spokes respectively when said double-throw double-pole switch is in said third position;

wherein said third position of said double-throw double-pole switch corresponds to a position whereby said double-throw double-pole switch contacts said second plurality of conductive nodes simultaneously, said double-throw double-pole switch contacting said second plurality of conductive nodes independently of said first plurality of said conductive nodes.

3. A method for assisting a user to stay warm during inclement weather conditions, said method comprising the steps of:

a. providing a concave canopy;

b. adapting said canopy to a folded position from an unfolded positions, said canopy being formed from waterproof material;

c. providing a shaft directly connected to a center region of said canopy;

d. providing a handle integrally attached to said shaft;

e. heating ambient air upwardly entering through said handle; and f. directing the heated air through said shaft and said canopy respectively;

wherein said canopy comprises:

a circular and flexible covering:

a plurality of linear spokes integrally attached to a lower surface of said covering along respective longitudinal lengths of said spokes, each of said spokes having a proximal end attached to a center region of said covering and further having a distal end extending radially away from said center region of said covering, each of said distal ends of said spokes terminating at an outer edge of said covering, each of said distal ends of said spokes being equidistantly spaced along said outer edge of said covering, each of said spokes having a hollow channel formed therein and extending along said longitudinal length thereof; and a plurality of holes formed in an outer surface of each of said spokes, said holes being in fluid communication with associated ones of said channels of said spokes, said holes being equidistantly spaced along said respective longitudinal lengths of each of said spokes, said holes facing toward an interior portion of said canopy when said canopy is adapted to the unfolded position;

wherein said shaft comprises:

an upper section having a top end directly connected to said center region of said covering and said proximal ends of said spokes respectively, said upper section having a bottom end extending downwardly and away from said top end of said upper section; and a lower section having a longitudinal length equal to a longitudinal length of said upper section, said lower section having a diameter that is greater than a diameter of said upper section such that said upper section is telescopically interfitted within said lower section and adjusted along said longitudinal length of said lower section;

wherein each of said upper and lower sections has a hollow passageway formed therein, each of said passageways being in fluid communication with each other and with said hollow channels of said spokes respectively;

wherein said handle is directly attached to a bottom end of said lower shaft, said handle having a hollow cavity formed therein, said cavity being in fluid communication with said passageway of said lower section of said shaft;

wherein step e. comprises the steps of:

providing a user interface formed in an exterior surface of said handle;

providing a first switch directly connected to said user interface and disposed exterior thereof;

providing a power supply source electrically coupled to said user interface, said power supply source being housed within said cavity of said handle;

providing a heating element electrically coupled to said first switch and said power supply source respectively, said heating element being housed within said cavity of said handle; and providing a fan electrically coupled to said user interface and said power supply source respectively and directly connected to said heating element, said fan being housed within said handle and located upstream of said heating element, said fan being in fluid communication with said heating element;

wherein step f. comprises the steps of:

providing a double-throw double-pole switch disposed exterior of said user interface and located adjacent to said first switch, said double-pole double-throw switch having a first plurality of conductive nodes and a second plurality of conductive nodes respectively, said double-throw double-pole switch being electrically coupled to said power supply source;

providing a distribution valve housing electrically coupled to said double-throw double-pole switch and said power supply source respectively, said valve housing being directly attached to said top end of said upper section of said shaft and said proximal ends of said spokes respectively; and providing a plurality of valves housed within said valve housing and electrically coupled thereto, each of said valves being in fluid communication with said passageway of said upper section of said shaft and an associated one of said proximal ends of said spokes respectively, said valve housing and said valves respectively cooperating to allow heated air from said shaft to pass therethrough and into selected ones of said spokes and outwardly through said associated ones of said holes respectively based upon a position of said double-throw double-pole switch.

4. The method of claim 3, wherein step f. further comprises the steps of:

i. directing heated air from said shaft through said plurality of valves and into said plurality of said spokes and outwardly through said plurality of said holes respectively when said double-throw double-pole switch is in a first position;

wherein said first position of said double-throw double-pole switch corresponds to a position whereby said double-throw double-pole switch simultaneously contacts a selected one of said first plurality of conductive nodes and a selected one of said second plurality of conductive nodes respectively;

ii. directing heated air from said shaft through a selected plurality of said valves and into an associated plurality of said spokes and outwardly through associated ones of said holes of said selected plurality of spokes respectively when said double-throw double-pole switch is in a second position, said double-throw double-pole switch simultaneously prohibiting heated air from said shaft from passing through another plurality of said valves and into another associated plurality of said spokes and outwardly through another associated ones of said holes of said another plurality of spokes respectively when said double-throw double-pole switch is in said second position;

wherein said second position of said double-throw double-pole switch corresponds to a position whereby said double-throw double-pole switch contacts said first plurality of conductive nodes simultaneously; and iii. directing heated air from said shaft through said another plurality of said valves and into said another associated plurality of said spokes and outwardly through said another associated ones of said holes of said another plurality of spokes respectively when said double-throw double-pole switch is in said third position, said double-throw double-pole switch simultaneously prohibiting heated air from said shaft from passing through said selected plurality of said valves and into said associated plurality of said spokes and outwardly through said associated ones of said holes of said selected plurality of spokes respectively when said double-throw double-pole switch is in said third position;

wherein said third position of said double-throw double-pole switch corresponds to a position whereby said double-throw double-pole switch contacts said second plurality of conductive nodes simultaneously, said double-throw double-pole switch contacting said second plurality of conductive nodes independently of said first plurality of said conductive nodes.

* * * * *